United States Patent [19]

Sweeney

[11] 3,947,368

[45] Mar. 30, 1976

[54] LUBRICATING OIL COMPOSITIONS

[75] Inventor: William M. Sweeney, Wappingers Falls, N.Y.

[73] Assignee: Texaco Inc., New York, N.Y.

[22] Filed: Feb. 25, 1971

[21] Appl. No.: 118,989

[52] U.S. Cl. ..... 252/56 R

[51] Int. Cl.[2]. C10M 1/28; C10M 3/22; C10M 5/12; C10M 7/26

[58] Field of Search ..... 252/56 R; 44/62

[56] References Cited

UNITED STATES PATENTS

| | | | |
|---|---|---|---|
| 3,048,479 | 8/1962 | Ilnyckyj et al. | 44/62 |
| 3,449,251 | 6/1969 | Tunkel et al. | 252/56 R |
| 3,462,249 | 8/1969 | Tunkel | 44/62 |
| 3,567,639 | 3/1971 | Aaron et al. | 44/62 |

FOREIGN PATENTS OR APPLICATIONS

| | | | |
|---|---|---|---|
| 1,197,813 | 7/1970 | United Kingdom | 252/56 R |

*Primary Examiner*—Daniel E. Wyman
*Assistant Examiner*—Y. H. Smith
*Attorney, Agent, or Firm*—T. H. Whaley; C. G. Ries; Walter D. Hunter

[57] ABSTRACT

Lubricating oil compositions having substantially reduced pour points are prepared by incorporating an effective pour depressant amount of an oil-soluble copolymer of ethylene and a vinyl ester of a lower saturated monobasic aliphatic carboxylic acid in a paraffinic, waxy-type, residual lubricating oil base stock. The copolymers, in which the lower saturated monobasic carboxylic component of the ester has from 2 to 6 carbon atoms, have molecular weights of about 16,000 to about 31,000 and which contain about 17 to about 42 weight percent of the vinyl ester, can be added to the lubricating base stock in the form of an emulsion, as a hydrocarbon solution or in any other convenient manner.

3 Claims, No Drawings

LUBRICATING OIL COMPOSITIONS

BACKGROUND OF THE INVENTION

1. Field of the Invention

This invention relates to an improved lubricating oil composition having a substantially reduced pour point. More particularly, this invention relates to an improved lubricating oil composition comprising a paraffinic waxy-type, residual lubricating oil base stock and from about 0.01 to about 0.50 weight percent of an oil-soluble copolymer of ethylene and a vinyl ester of a lower saturated monobasic aliphatic carboxylic acid.

2. Description of the Prior Art

Heating oils, diesel fuels, lubricating oils and other liquid hydrocarbon oils employed in cold climates or exposed to low temperatures frequently require the use of an additive to maintain their fluidity or to meet critical pour point specifications for the oil in question. Additives that are effective for this are called pour depressants. The art discloses numerous classes of pour depressants.

Such lubricating oil additives are mostly high molecular weight organic compositions prepared by alkylation of benzene, naphthalene or derivatives, by polymerization of low molecular weight methacrylates or by condensation polymerization of various types. Many are not entirely suitable because of their high cost, or the high concentration required, or because they do not lower the pour point to the required temperature. An effective pour depressant is one which will substantially reduce the pour point of a treated oil when used in small concentration without imparting any undesirable effects.

Although the wide variety of differeent pour depressants mentioned above are useful for incorporating in heating oils, diesel fuels and many other liquid hydrocarbon oils, it has been found that such additives are generally ineffective in paraffinic, waxy-type, residual lubricating oil base stocks. The poor performance of these additives may result from the structural differences of waxes occurring in lubricating oils derived from different locations. It is well known, for example, that acrylate and methacrylate esters of aliphatic acids having eight carbon atoms or more can be polymerized to make high molecular weight products which are soluble in lubricating oils and generally are capable of improving or lowering the pour points of a variety of lubricating oils. With the paraffinic, waxy-type, residual lubricating oil base stocks these materials do not provide the pour point reductions required.

Two principal processes have been employed in attempting to improve the pour point characteristics of paraffinic, waxy-type, residual lubricating oil base stocks, namely, the solvent extraction process and the centrifugal dewaxing method. Solvent dewaxing involves introducing and recovering a largee amount of valuable solvent material which necessarily results in an expensive operation. In the centrifugal method of separating the wax, it is necessary to first cool the oil to a low temperature such as about −25°F, which is a time-consuming and costly processing step.

Another approach which has been employed has been to dilute or cut the lubricating oil stock with a major amount of a lighter hydrocarbon oil. Thermocracking of the waxy lubricating oil base stock has been attempted; however, this process which does result in the reduction of the pour point to 10°–20°F also leads to the loss of a substantial volume of lubricating oil stock due to poor selectivity in cracking the wax that causes the high pour point. There is, therefore, a need in the art for an economic process to form improved lubricating oil compositions utilizing as the major component paraffinic, waxy-type, residual lubricating oil base stocks.

A main object of the present invention is to improve the pour point characteristics of paraffinic, waxy-type, residual lubricating oil base stocks without using elaborate and expensive solvent extraction or centrifugal dewaxing procedures.

Another object of this invention is to provide improved lubricating oil compositions prepared by incorporating a minor amount of an oil-soluble copolymer of ethylene and a vinyl ester of a saturated monobasic aliphatic monocarboxylic acid in a paraffinic, waxy-type residual lubricating oil base stock.

Another object of this invention is to improve the paraffinic, waxy-type, residual lubricating oil base stocks so that they may be handled with greater ease and flexibility in climates where the ambient temperatures are near their upper pour points.

SUMMARY OF THE INVENTION

The novel improved lubricating oil compositions of this invention comprise a major amount of paraffinic, waxy-type, residual lubricating oil base stock and effective pour depressant amount of an oil-soluble copolymer of ethylene and a vinyl ester of a saturated monobasic aliphatic carboxylic acid.

DETAILED DESCRIPTION OF THE INVENTION

The waxy-type lubricating oil base stocks which may be employed in preparing the improved lubricating compositions of the invention are paraffinic, waxy-type, residual lubricating oil base stocks which preferably have pour points of from about +40° to +130°F. A paraffinic, waxy-type residual lubricating oil base stock which has given particularly good results with the present additives is known as 700 Firestock having a SSU Vis. at 210°F of 273 and a pour point of 80°–100°F. Mixtures of the paraffinic, waxy-type, residual lubricating oil base stocks may also be employed, if desired.

The pour point depressant additives useful in the practice of this invention include oil-soluble copolymers of ethylene and vinyl esters of a lower saturated monobasic aliphatic carboxylic acid, in which the carboxylic acid component of the ester has a carbon content of from about 2 to about 6, the copolymers having molecular weights of about 16,000 to about 31,000 as determined by the Number Average Molecular Weight by the Membrane Osmometry Analytical Method, a vinyl ester content of from about 17 to about 42 percent and a melt index of from 5 to 580. The preferred copolymers are sold under the trade name of "Elvax" by E. I. Pont du Nemours Company, the most suitable being Elvax 250 which contains 27 to 29 percent vinyl acetate, has an inherent viscosity at 100°F of 0.78 dcl/gm in toluene; a softening point as determined by ASTM E 28 of 280°F; a cloud point in paraffin wax of 150°F, a melt index of 12–18; and a molecular weight of about 23,000 to about 27,000. The material is supplied by the manufacturer for use in blends containing wax, such as coating compositions for paper milk cartons to provide toughness, flexibility, adhesion and barrier properties — properties having nothing in common with pour point reduction in lube oil blends. The subject resin additive can be prepared by a variety of processes, such as that of U.S. Pat. No. 3,215,678 in which the free radical-initiated polymerization reaction of ethylene and a vinyl ester of a lower saturated monobasic aliphatic carboxylic acid is described.

The characterization of the various "Elvax" additives is given in Table 1 below:

TABLE 1

| "ELVAX" | % Vinyl Acetate in Copolymer | Melt Index* |
|---|---|---|
| 40 | 39–42 | 45–70 |
| 150 | 32–34 | 22–28 |
| 210 | 27–29 | 335–465 |
| 220 | 27–29 | 125–175 |
| 240 | 27–29 | 22–38 |
| 250 | 27–29 | 12–18 |
| 260 | 27–29 | 5–7 |
| 310 | 24–26 | 335–465 |
| 350 | 24–26 | 16–22 |
| 360 | 24–26 | 1.6–2.4 |
| 410 | 17–19 | 430–580 |
| 460 | 17–19 | 2.1–2.9 |

*in g/10 min as determined by ASTM 1328 modified

Suitable ethylene-vinyl ester copolymers are also sold under the trade name of "Zetafax 1570 and 1578". "Zetafax 1570" is an ethylene-vinyl acetate copolymer containing 27 weight percent vinyl acetate having a melt index of 5. "Zetafax 1575" is a similar ethylene-vinyl ester copolymer of molecular weight of about 20,700, a melt index of 12–15 and containing 27 weight percent of vinyl acetate.

The specific properties of the paraffinic, waxy-type, residual lubricating oil base stocks used in the examples illustrating various embodiments of this invention appear in Table 1-A.

In preparing the novel improved lubricating oil composition of this invention the waxy-type lubricating oil base stock and the copolymer additive are mixed together at ambient temperature and the resulting mixture heated with continued mixing to a temperature of about 120° to about 250°F, and, preferably, at about 140° to abount 170°F to form the improved lubricating oil composition.

The quantity of the copolymer added can be varied widely and although it is only necessary to add an effective pour depressant quantity, this amount will necessarily depend upon the physical characteristics of the paraffinic, waxy-type, residual crude oil lubricating base stock, the particular polymer employed, etc. Usually from about 0.01 to about 0.50 percent by weight and, preferably, from about 0.05 to about 0.15 percent by weight of the copolymer additive based on the weight of the finished improved lubricating oil composition is employed. Mixtures of the useful copolymer additives may be utilized, if desired.

such as a water-ethylene glycol emulsion, or in a hydrocarbon, such as toluene, kerosene, a Udex gasoline fraction, etc. Suitable emulsions can be prepared by dissolving the copolymer in a hydrocarbon such as kerosene, etc. and then emulsifying the hydrocarbon-polymer solution with a mixture of an alkylene glycol, such as ethylene glycol, propylene glycol, etc., water and detergent to form an oil-in-water emulsion. The resulting emulsion will exhibit a pour point and viscosity close to that of the water-glycol phase. An example of this approach is the use of a water-ethylene glycol emulsion containing about 22 percent of the copolymer. This method is especially useful if the additive is to be exposed to cool weather as a similar concentration of the copolymer in a light hydrocarbon has a pour point at or above room temperature and is quite viscous due to the thickening power of the copolymer.

It will be evident to those skilled in the art that other additives commonly employed in lubricating oil compositions may be added to the lubricating oil compositions of this invention. Such additives include rust inhibitors, anti-emulsifying agents, anti-static agents, anti-oxidants, etc.

The following examples illustrate various embodiments of this invention, and are to be considered not limitative. In the examples the pour points given were determined by ASTM method D-97-47.

EXAMPLES I-XIV

In this series of examples a variety of Elvax copolymers were added to the same paraffinic, waxy-type, residual lubricating oil base stock and the pour points were measured. Preparation of the compositions was accomplished by stirring together the copolymer and the base stock for 30 minutes at 150°F. For comparison purposes, the reduction in pour point resulting when a methacrylate type copolymer pour point depressant was added to the same base stock was determined (see Example XIV). The compositions tested and the results obtained are included in Table 2.

Data shown in Table 2 reveal that the Elvax copolymers are very effective in reducing the pour points of paraffinic, waxy-type, residual lubricating oil base stocks while the addition of almost three times as much lauryl-stearyl methacrylate has virtually no effect on the pour point of the base oil.

EXAMPLES XV-XXI

In this series of examples the effect of the concentration of the Elvax copolymers on the reduction in pour point of a paraffinic, waxy-type, residual lubricating oil base stock was demonstrated. Pertinent data relating to these tests is shown in Table 3.

TABLE I-A

| Paraffinic, Waxy-Type, Residual Lubricating Oil Base Stocks | | | | |
|---|---|---|---|---|
| Name: | 700 Firestock | Hytex 650 | DA-SR Cylinder Stock | Grease Plant Black Oil |
| Origin of Crude | West & North Texas Special | North Texas Special | North Texas Special | S. Louisiana Lt. Reg. |
| Processes on | Distillation | Distillation | Distillation | Distillation |
| Crude to yield stock | Deasphalted | Deasphalted | Deasphalted | — |
| Vis SSU at 210°F | 273 | 176 | 159 | 59 |
| Pour Point, °F | 100, 95, 85, 80, 95 | 110 | 105 | 65 |

The copolymer may be added to the lube oil base stocks directly as granules; in a water-glycol emulsion,

EXAMPLES XXII-XXVII

In this series the substantial reduction in pour points achieved with four different paraffinic, waxy-type, residual lubricating stocks is shown. Pertinent details relating to these examples appear in Table 4.

As the data indicate the addition of up to 4 times as much of a methacrylate pour depressant to certain of these base stocks resulted in very little change in the pour points.

EXAMPLES XXVIII-XXXI

In this series of examples the effect of storage time on the pour points and viscosities of blends of paraffinic, waxy-type, residual lubricating oil base stocks was determined. Data relating to these experiments which are set forth in Table 5 indicate very little change in pour points or viscosities at the end of three months storage time.

EXAMPLES XXXII-XXXIV

In another series of tests the pour depression effect achieved with Elvax 210 in paraffinic, waxy-type, residual lubricating oil stock was compared to that obtained with a methacrylate type pour point depressant. Pertinent details relating to these examples are set forth in Table 6. Data presented in Table 6 show the substantial pour point reduction achieved with Elvax 210 whereas with the methacrylate pour point depressant no reduction at all was observed in pour points of the resulting blends.

In Table 7 which follows, data is presented showing the shear stability of a paraffinic, waxy-type, residual lubricating oil base stock containing 0.1 percent by weight of Elvax 150 when compared to the base stock itself. The data indicate that there is little or no loss of pour depression activity on completion of the standard shear test and even after storage of 3 months.

TABLE 2

Activity of Various Elvax Copolymers in Waxy Lube Stock

| Example | Elvax Copolymer | Pour Points/ Max Points (°F)[1] | % Vinyl Acetate Elvax Copolymer[2] | Elvax Melt Index |
|---|---|---|---|---|
| I | None | 100/— | — | — |
| II | 40 | 45/55 | 39–42 | 45–70 |
| III | 150 | 35/45 | 32–34 | 22–28 |
| IV | 210 | 35/45 | 27–29 | 335–465 |
| V | 220 | 45/55 | 27–29 | 125–175 |
| VI | 240 | 45/50 | 27–29 | 22–28 |
| VII | 250 | 40/50 | 27–29 | 12–18 |
| VIII | 260 | 65/— | 27–29 | 5–7 |
| IX | 310 | 50/50 | 24–26 | 335–465 |
| X | 350 | 70/— | 24–26 | 16–22 |
| XI | 360 | 45/50 | 24–26 | 1.6–2.4 |
| XII | 410 | 45/55 | 17–19 | 430–580 |
| XIII | 460 | 50/60 | 17–19 | 2.1–2.9 |
| XIV | 3 | 95/— (at 0.405%) | | |

[1]Concentration 0.15% copolymer added as 10% Udex gasoline solution to 700 Firestock (see Table 1 for physical properties), no storage time.
[2]Vendors information, Melt Index g/10 min. ASTM D-1238 modified.
[3]A lauryl-stearyl methacrylate copolymer pour depressant Mn about 300,000.

TABLE 3

Effect of Concentration of Selected Elvax Copolymers on Pour Point of 700 Firestock[1,2]

| Example | Elvax Copolymer Concentration, Wt. %3 | 150 | 210 | 250 |
|---|---|---|---|---|
| XV | 0.0 | 90,85 | 90,85 | 90,85 |
| XVI | 0.015 | 55/60 | 75/— | 65/— |
| XVII | 0.030 | 45/55 | 55/60 | 55/60 |
| XVIII | 0.050 | 55/50 | 35/30 | 40/45 |
| XIX | 0.10 | 35/45 | 40/35 | 40/35 |
| XX | 0.15 | 35/45 | 40/45 | |
| XXI | 0.20 | 30/35 | 35/35 | |

[1]No storage time, copolymer added as 10% solution in Udex gasoline.
[2]See Table 1 for physical properties.
[3]Compositions of this series prepared by stirring together the copolymer and base stock for 30 minutes at 150°F.

TABLE 4

Pour Points and Viscosities of Several Waxy Lubricant Stocks with added Elvax Copolymers[1,4]

| Example No. | Waxy Lubricant Base Stock | Grease Plant Black Oil[3] | | 700 Firestock[3] | |
|---|---|---|---|---|---|
| | Elvax Copolymer (0.1wt.%) | Pour/Max. Pour, °F | Kin.Vis.at 210°F, cs | Pour/Max. Pour, °F | Kin.Vis.at 210°F, cs |
| XXII | None | 65/— | 8.90 | 80/— | 59.6 |
| XXIII | 150 | 10/35 | 9.08 | 35/45 | 57.8 |
| XXIV | 210 | 10/25 | 9.08 | 40/45 | 59.6 |
| XXV | 250 | 20/40 | 8.99 | 35/50 | 58.8 |
| XXVI | [2]0.4 wt.% | — | | — | |
| XXVII | [2]0.4 wt.% | — | | — | |

| Example No. | Hytex 650[3] | | Deasphalted Straight Run Cylinder Stocks[3] | |
|---|---|---|---|---|
| | Pour/Max. Pour, °F | Kin.Vis. at 210°F, cs. | Pour/Max. Pour, °F | Kin. Vis. at 210°F, cs. |
| XXII | 110/— | 38.3 | 105/— | 33.3 |
| XXIII | 50/— | 37.3 | 65/95 | 33.2 |
| XXIV | 75/— | 38.1 | 85/— | 33.5 |
| XXV | 70/— | 37.7 | 70/— | 33.8 |
| XXVI | 115/— | 39.7 | 115/— | 35.1 |
| XXVII | 115/— | 41.9 | 115/— | 37.1 |

[1]No storage time, copolymer added as 10% solution in Udex gasoline.
[2]A lauryl-stearyl methacrylate copolymer (8:2 ratio, $\overline{M}n$ about 300,000).
[3]See Table 1 for physical properties.
[4]Compositions prepared by stirring together copolymer and base stock at 180°F for 1 hour.

TABLE 5

Pour Point and Viscosity Data on Blends of Waxy Stocks Containing Elvax 150

| Storage Time, Months: | | 0 | | 3 | |
|---|---|---|---|---|---|
| Example | Blend[2] | Pour Point/Max Pour Point, °F | Kin Vis at 210°F, cs | Pour Point/Max Pour Point, °F | Kin Vis at 210°F, cs |
| XXVIII | 700 Firestock, 70%[3] DA-SR Cylinder Stock[1], 30%[3] | 105/— | 50.7 | 115/— | — |
| XXIX | above + 0.12 wt.% Elvax 150 | 35/65 | 50.9 | 40/45 | 51.0 |
| XXX | 700 Firestock[1], 50%[3] DA-SR Cylinder Stock[1], 50%[3] | —/105 | — | —/105 | — |
| XXXI | above + 0.12 wt.% Elvax 150 | 45/65 | 47.8 | 45/45 | 47.8 |

[1]See Table 1 for physical properties.
[2]Blends prepared by stirring together copolymer and base stocks at 180°F for 1 hour.
[3]Percentages given are by volume.

TABLE 6

Comparison of Pour Point Depression Effect of Elvax 210 and a Methacrylate Type Pour Point Depressant in Waxy Blends

| Storage Time, Months: | | 0 | 3 |
|---|---|---|---|
| Example | Waxy Blends[3] | Maximum Pour Point, °F | Pour Point, °F |
| XXXII | Firestock 700[2], 70%[4] DASR Cylinder Stock[2], 30%[4] | 105 | 105 |
| | above base + 0.05 wt.% Elvax 210 | 60 | 65 |
| | above base + 0.05 wt.% Pour Depressant A[1] | 95 | 100 |
| XXXIII | Firestock 700[2], 50%[4] Hytex 650[2], 50%[4] | 100 | 115 |
| | above base + 0.05 wt.% Elvax 210 | 60 | 70 |
| | above base + 0.5 wt.% Pour Depressant A[1] | 105 | 115 |
| XXXIV | Firestock 700[2], 70%[4] Hytex 650[2], 30%[4] | 90 | 100 |
| | above base + 0.05 wt.% Elvax 210 | 65 | 70 |
| | above base + 0.5 wt.% Pour Depressant A[1] | 90 | 95 |

[1]Pour Depressant A — a lauryl-stearyl methacrylate copolymer (8:2 ratio — $\overline{M}n$ about 300,000).
[2]See Table 1 for physical properties.
[3]Blends prepared by stirring together copolymer and base stocks for 1 hour at 180°F.
[4]Percent by volume.

TABLE 7

Effect of Shearing on Pour Point of Grease Plant Black Oil[2] with added Elvax 150

| | Pour Point, °F | |
|---|---|---|
| Storage Time, Months | 0 | 3 |
| Base Stock | | |
| Before Shearing | 45 | 65 |
| After Shearing[1] | 60 | 55 |
| Base Stock + 0.1 wt.% Elvax 150 | | |
| Before Shearing | 20 | 20 |
| After Shearing[1] | 15 | 35 |

[1]Fuel Injector Shear Stability Test, 20 passes.
[2]See Table 1 for physical properties.

What is claimed is:

1. A lubricating oil composition having improved pour point characteristics which comprises a paraffinic, waxy-type, residual lubricating oil base stock and about 0.01 to about 0.50 percent by weight of an oil-soluble copolymer of ethylene and a vinyl ester of a saturated monobasic aliphatic carboxylic acid in which the carboxylic acid component of the ester has from 2 to 6 carbon atoms, said copolymer having a molecular weight of about 16,000 to about 31,000, a vinyl ester content of about 12 to about 42 percent by weight, and a melt index of about 5 to about 580.

2. The composition according to claim 1 wherein the said vinyl ester is vinyl acetate.

3. The composition according to claim 1 wherein the said copolymer is an ethylene-vinyl acetate copolymer having a molecular weight ranging from about 23,000 to about 27,000.

* * * * *